US005088531A

United States Patent [19]

Wade

[11] Patent Number: 5,088,531

[45] Date of Patent: Feb. 18, 1992

[54] WASTE COLLECTION DEVICE

[76] Inventor: Bita L. Wade, 4892 Lake Dr., Memphis, Tenn. 38117

[21] Appl. No.: 607,110

[22] Filed: Dec. 11, 1990

[51] Int. Cl.[5] ..... A01B 1/04

[52] U.S. Cl. ..... 141/108; 141/391; 15/257.1

[58] Field of Search ..... 141/108, 109, 390, 391; 15/257.1

[56] References Cited

U.S. PATENT DOCUMENTS

| | | | |
|---|---|---|---|
| D. 283,196 | 4/1986 | Hasse | 141/108 X |
| 121,529 | 12/1871 | Lum | 141/108 X |
| 1,182,412 | 5/1916 | Olesberg | 141/108 X |
| 1,683,517 | 9/1928 | Bentley | 15/257.1 |
| 1,847,476 | 3/1932 | Fuhr | 15/257.1 |
| 2,782,615 | 2/1957 | Johnson | 15/257.1 |
| 4,149,745 | 4/1979 | Willis | 15/257.1 |
| 4,825,915 | 5/1989 | Hess et al. | 141/392 X |

FOREIGN PATENT DOCUMENTS

| | | | |
|---|---|---|---|
| 125225 | 9/1947 | Australia | 15/257.1 |
| 370825 | 4/1932 | United Kingdom | 15/257.1 |

*Primary Examiner*—Ernest G. Cusick

[57] ABSTRACT

A waste collection device is designed to assist a person in the collection of yard wastes. The device is in the form of a rectangular generally box-shaped configuration. It includes side wall, a bottom wall, a back wall, a top wall and an open front. The top wall has a generally elliptically shaped opening extending from the front end near the open front toward the back wall but terminating short of the back wall. The opening allows a user of the device to push yard wastes into the box and backward into the box so as to compress the materials therein. A handle is positioned on the top wall to enable the user to lift the device to deposit materials collected into the device into larger containers.

2 Claims, 2 Drawing Sheets

WASTE COLLECTION DEVICE

BACKGROUND OF THE INVENTION

1. Field of the Invention

This invention is related to a collection device to aid the user in capturing debris, especially lawn and yard debris. It is designed to aid in the collection of such wastes, and to further assist in the deposit into other larger waste containers, such as trash bags, cans, or other like waste containers.

Lawn and yard care equipment are designed to assist the user in making their work easier and more efficient. The present device is also designed to achieve this function, however the processes of the past can be expedited with the present device, as it allows the user to expend less energy in doing the yard work.

2. Description of the Prior Art

Previously, the person doing yard work expended a great deal of energy in the collection of yard wastes. In the past, to collect wastes, the person would either use the rake to pick up the yard debris and place it into a larger container or would use their hands. These old methods result in a great deal of energy being used, and are time consuming.

SUMMARY OF THE INVENTION

The present invention is directed to a novel and convenient device, and its method of operation, for the collection of yard wastes, in an efficient and speedy manner. The design of the present invention is such that the device is lightweight and easy to use, carry and manipulate.

The collection device is constructed from a lightweight material, such as plastic or aluminum. The device takes the general configuration of a rectangular "box", but has one of its smaller rectangular sides totally open. The top side is configured with a smooth opening in the general form of an ellipse, extending from the intersection of the corner of the "box" to point along the top side. A handle is positioned on this top side to permit manipulation and lifting of the device for its use.

The front opening is designed for the ingress of yard wastes into the "box" while the top opening permits a user to push and compress the wastes into the rear of the device opposite the side opening by a rake or broom. This of course, will allow for more waste material to be placed into the device compared to if the material was not pushed and compressed into the rear of the device.

Once a sufficient amount of material is placed into the device, the user can pick up the device, preferably by using the handle on the top side, and deposit the wastes into a larger waste container.

With the above, the other objects in view that will hereinafter appear, the nature of the invention will be more clearly understood by reference to the following detailed description, the appended claims and the views presented in the accompanying drawings.

DETAILED DESCRIPTION OF THE PREFERRED EMBODIMENTS

Figure 1:
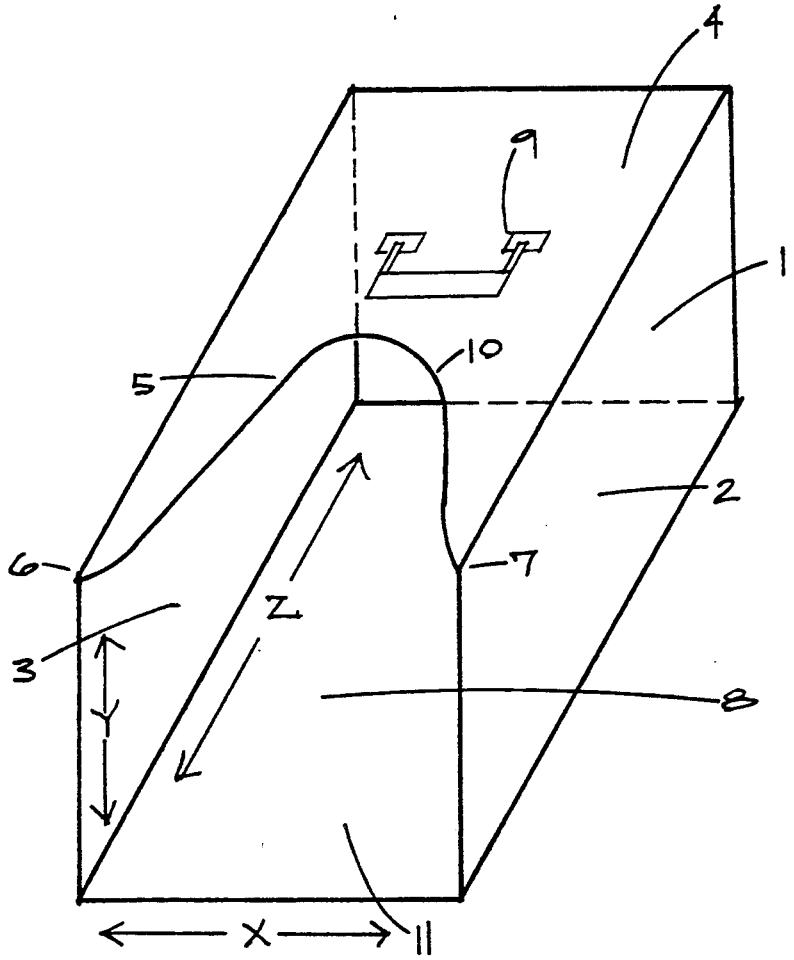
FIG. 1 is a top, frontal perspective view of the collection device showing the front opening and top opening.
Figure 2:
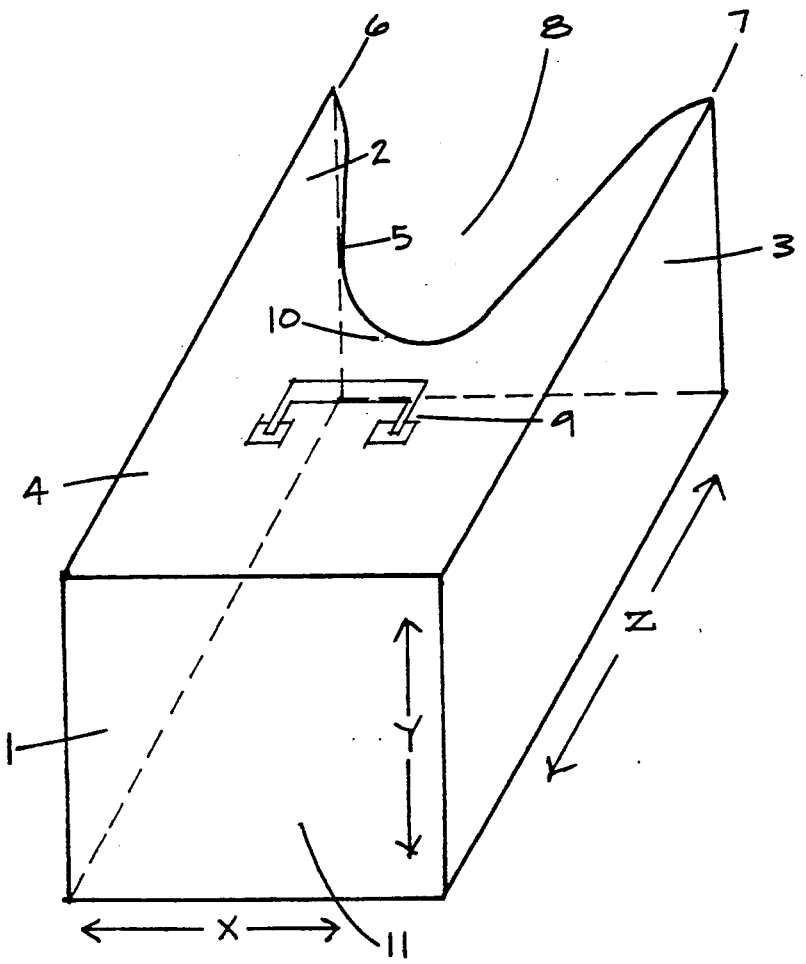
FIG. 2 is a rear, top perspective view showing the closed rear end of the collection device.

Referring to the figures, the collection device A is in the form of a rectangular box, having a front opening and an opening in the top side. The box has a front opening at 8 for the ingress of waste materials as will be explained hereafter. The rear side is closed by a wall 1. The two side walls 2 and 3 have front and rear ends and are continuous from the front opening 8 to the rear closed end at 1. The top wall 4 also has front and rear ends and if formed with a generally elliptical opening 5 extending from the front end along the top side toward the rear end proximate the closed rear at wall 1. A bottom wall 11 has front and rear ends and is identical in length to the side walls 2 and 3 and is opposite the top wall 4. It also extends from the front opening to the rear wall. The generally elliptical opening is started at the corners 6 and 7 of the box and narrows in shape toward its apex 10 near the rear of the device. A handle 9 is positioned on the top wall between the closed end at 1 and the apex 10 of the generally elliptical opening 5. The handle may be attached by screws (not shown) to the top wall.

The device is preferably constructed of a lightweight material so that it is easy to lift. Plastic or aluminum are acceptable materials.

The opening 5 is shaped to be large enough to permit a rake or broom to enter the device and be move back into the housing 5. The preferred dimensions of the device are, with respect to FIG. 1, the width x, 11"; the height y, 9"; the length z, 16"; the extent of the opening 5 being 8". The handle is preferably place at a distance of 11" from the front opening.

In use, the device is placed by the user proximate the yard waste to be picked up. The user then pushes the waste up into the device through the front opening 8, utilizing a rake or broom. The rake or broom can then be moved past the front opening 8 along said generally elliptical opening 5 into the confines of the box as is defined by the top, bottom and side walls, at their front ends, proximate 8. This continued movement of the rake or broom into the device will tend to compress the materials in the box, and inherently allow for more materials to be placed in the box. When a sufficient amount of materials have been placed into the device, it is lifted by the user employing the handle 9, and the materials in the device can be placed into a larger waste container.

I claim:

1. A waste collection device for the collection of waste materials especially yard wastes comprising:

a rectangular back wall;

a pair of rectangular side walls having a front and a rear end;

a rectangular bottom wall having a front and a rear end;

and a rectangular top wall having a front wall and rear end, said top wall also having a generally elliptically shaped opening extending form the front end toward the rear end but terminating at an apex short of the rear end, the generally elliptically shaped opening originating at corners of the front end of the rectangular top wall;

said rear ends of said pair of side walls, said bottom wall and said top end joined together at said back wall to form a generally rectangularly box-shaped configuration;

said box configuration having an open front end proximate said front ends of said pair of side walls, said bottom wall and said top end at the origination of said generally elliptically shaped opening;

said open front end being large enough to allow a user of said device to move waste materials into the box-shaped configuration through the assistance of a rake or broom;

said generally elliptically shaped opening being sufficiently large enough to permit the rake or broom to be moved inside the box-shaped configuration toward the back wall to compress the waste materials.

2. A waste collection device as claimed in claim 1, wherein the top wall further has a handle disposed on its exterior between said apex and said rear end of the top wall.

* * * * *